United States Patent [19]

Kerekes

[11] 4,221,987

[45] Sep. 9, 1980

[54] HIGH-PRESSURE DISCHARGE TUBE OPERABLE IN THE OPEN AIR WITHOUT OUTER PROTECTIVE ENVELOPE

[75] Inventor: Béla Kerekes, Budapest, Hungary

[73] Assignee: Egyesült Izzólámpa és Villamossági Részvénytársaság, Budapest, Hungary

[21] Appl. No.: 944,722

[22] Filed: Sep. 21, 1978

Related U.S. Application Data

[63] Continuation-in-part of Ser. No. 614,475, Sep. 18, 1975, abandoned.

[30] Foreign Application Priority Data

Dec. 20, 1974 [HU] Hungary ..... EE 2299

[51] Int. Cl.[3] ..... H01J 61/073; H01J 61/30; H01J 61/52

[52] U.S. Cl. ..... 313/42; 313/44; 313/217; 313/220

[58] Field of Search ..... 313/220, 42, 46, 217

[56] References Cited

U.S. PATENT DOCUMENTS

| | | | |
|---|---|---|---|
| 2,177,714 | 10/1939 | Hagen et al. | 313/220 X |
| 3,248,590 | 4/1966 | Schmidt | 313/184 |
| 3,650,593 | 3/1972 | Kerekes | 313/220 X |
| 3,693,007 | 9/1972 | Kerekes | 313/220 X |
| 3,821,587 | 6/1974 | Liberman et al. | 313/220 X |
| 3,898,494 | 8/1975 | Levy | 313/217 X |

*Primary Examiner*—Palmer C. Demeo
*Attorney, Agent, or Firm*—Gabriel P. Katona

[57] ABSTRACT

The high-pressure electric discharge tube of the invention can operate in the open air, with at least 10 Hg mm inner pressure. It has a preferably ceramic (or crystalline) envelope that constitutes an illuminator, with electrodes disposed in two opposite portions of the envelope, appropriate inlets, lead-ins and terminals leading to the electrodes. The discharge tube does not have to be surrounded by the hitherto applied, conventional, glass or other transparent protective envelope, as a result of which the emitted luminous output is free from reflections and the tube can be used throughout the entire spectrum, such as for pumping or driving a laser crystal. The protective envelope, which so far has been an indispensable part of all high-pressure discharge tubes, has been eliminated as a result of the present invention. Adapter tubes are used that prevent oxidation of the electrical elements, as well as specially configured electrodes.

4 Claims, 1 Drawing Figure

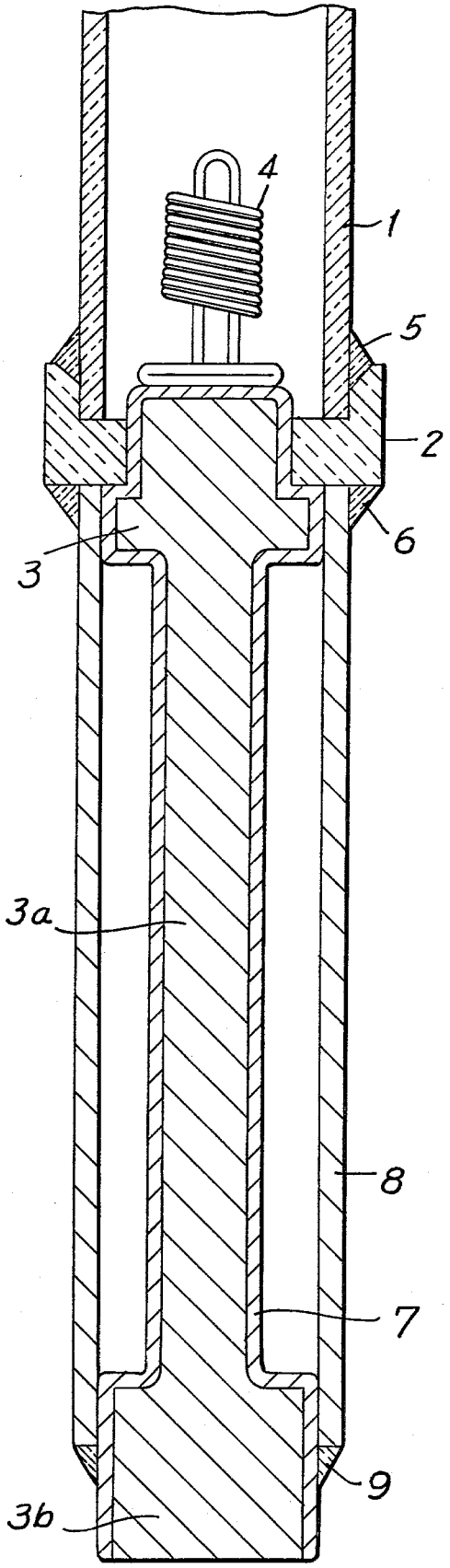
4
1
5
2
6
3
3a
8
7
9
3b

HIGH-PRESSURE DISCHARGE TUBE OPERABLE IN THE OPEN AIR WITHOUT OUTER PROTECTIVE ENVELOPE

This is a continuation-in-part of patent application Ser. No. 614,475 filed by the same inventor on Sept. 18, 1975, titled "High-Pressure Electric Discharge Tube . . . ", now abandoned.

The present invention relates to a high-pressure electric discharge tube, preferably containing metal- and/or metallic salt vapors, provided with a ceramic (possibly crystalline) envelope, operable in the open air, hence without the customary protecting envelope. Appropriate terminals, lead-ins and inlets lead to the electrodes. The inventive discharge tube does not have to be surrounded by the hitherto indispensable protective envelope so that the emitted luminous output is free of reflections, and the tube can be used throughout the entire spectrum, also for laser devices. The protective envelope has thus been eliminated, the invention using instead adapter tubes that prevent oxidation of the electrical terminals, as well as specially configured electrodes. The adapter tubes are vacuum-tightly sealed or filled with an inert gas.

Well known are the so-called mercury-, sodium-vapor, or metallic high-pressure halogen discharge lamps, characterized in that at the coolest points thereof, where the electric inlets are arranged, the temperature amounts to 700° to 800° C. in order to reach a proper vapor pressure for the discharge materials. Such tubes cannot be operated in the open air since the electric inlets are made of substances, e.g. molybdenum, niobium, tungsten, etc., which tend to rapidly oxidize at the explained working temperature.

With these types of lamps protection from oxidation is conventionally ensured by placing the discharge tube into a protective glass envelope or bell in which a high vacuum is maintained, or it is filled with an inert gas. The external envelope does not hinder the operation of the discharge tube, moreover there are even some advantages involved, as the discharge tube is protected from the rigors of the weather. Such solutions are described in U.S. Pat. Nos. 3,248,590, 3,650,593 and in Hungarian Pat. No. 157,478.

To meet increased requirements in relation to these light sources and taking new fields of application into consideration, special high-pressure gas-discharge tubes had to be produced without protective envelopes. Such a new field is, for example, the excitation of laser crystals where the light reflection of the protective envelope, and the circumstance that the latter does not transmit the ultra-violet spectrum, create highly unfavorable conditions, thus making impossible the use of the discharge tubes if provided with the traditional protective envelopes.

The task has been made more difficult by the fact that protection of the electrical inlets of the discharge tubes from oxidation is an absolute necessity. In view of the spectral requirements, the tube has to be filled with an alkali metal, e.g. potassium and/or rubidium, if use for lasers is envisaged, or with sodium for illumination; for these reasons the material of the discharge-tube envelope cannot be glass only a ceramic (or crystalline) material.

It is known from U.S. Pat. No. 2,177,714 that discharge tubes have been made by using glass (a vitreous material), where the current inlets were surrounded by chambers secured to the envelope of the actual discharge tube. Apart from the inlets and electrodes, all constituent parts of these lamps had however to be made of a completely fused-together glass, which did not present particular manufacturing difficulties on account of the physical characteristic of glass since it becomes gradually softer upon being heated, and can thus be easily worked and connected with other parts by melting and fusing.

If however the envelope of the discharge tube has to be ceramic, the lamp according to the just mentioned patent cannot be realized on account of the lack of a softening zone in ceramics. It is not possible to weld or fuse the electric conductors directly with ceramic material in a vacuum-tight manner, and neither is it possible to shape the one-piece device, having chambers at both ends, from a crystalline material.

The construction of such discharge lamps or tubes, attempting to use ceramic envelopes, led to U.S. Pat. No. 3,821,587. Here the electric conductors are protected from oxidation by locking air out with ceramic bells, platinum foil being used to conduct the current to the electrodes of the actual discharge space (the illuminator), through a glue applied to the surfaces of the bell and the discharge tube.

It is a disadvantage of this solution that—although platinum resists oxidation by air—the heat-expansion coefficients of platinum and ceramics or crystalline substances are different so that thermal shocks occur, as a result of which the welded elements (platinum, ceramics, a unitary crystalline member) get separated, or at least the connection is loosened so that air can enter the discharge tube.

To eliminate the enumerated drawbacks, the inventor succeeded in finding a solution which can be applied in a variety of embodiments but shows the common characteristic that at both ends of the illuminator or envelope of the discharge tube there is applied a vacuum-sealed adapter tube, made of a ceramic (or crystalline) substance, sealed and fused directly or suitably by inserting ceramic spacers or collars to the envelope.

The adapter tubes surround the electric inlets at the ends of the discharge tube and protect them against oxidation in that they are terminated at the free ends with vacuum-sealed current inlets. The electrical lead-ins inside the adapter tubes, between the outer sealed terminals and the conductors at the ends of the discharge tube (illuminator) proper, are electrically interconnected. In the adapter tubes, which preferably have lengths of at least 35 millimeters, there is vacuum or an inert gas; the electrical inlets and lead-ins, and the terminals of the discharge tube, may form a monolithic unit suitably made of a ceramic material with surface metallization.

By means of the aforesaid solution the inventor succeeded in providing a high-pressure electrical discharge tube that can be operated in the open air without any protective outer envelope, partly by suitably protecting the inlets, namely in vacuum-tightly sealed chambers, constituted by the adapter tubes, from oxidation taking place at a high temperature in the open air. The inventive discharge tube has the advantage of being capable of economical manufacture by large-scale production procedures.

The service life of the tubes according to the present invention can easily reach 10,000 working hours. With these properties, the inventive tube complies with all special optical requirements, thus being suitable for the application as an exciter lamp for laser crystals, ensuring at the same time the required light spectrum and reflection-free light.

A preferred exemplary embodiment of the invention is described in the following, with reference to the sole FIGURE of the accompanying drawing.

Shown is one-half of a discharge tube, a complete illustration of which can be seen, in a conventional manner, in the earlier-mentioned U.S. Pat. No. 3,821,587. The inventive discharge tube, having symmetrically shaped ends as just explained, comprises an illuminator enclosed in a ceramic (or crystal, that is non-vitreous) envelope 1, an optional ceramic collar or spacer 2 welded or fused to each end thereof, monolithic elongated members 3 fitted into the collars, and electrodes 4 attached to the inner ends of the members 3 which will be further explained hereunder.

The centrally arranged envelope 1 has fitted to its two ends adapter tubes 8 in accordance with one of the important features of the invention, which contain a vacuum or an inert gas. There is preferably a molybdenum or tungsten (metal or metallized) layer 7 applied to each member 3, and also to a lead-in portion 3*a* thereof, and to a portion 3*b* that constitutes a terminal for connecting the discharge tube to a requisite electric source.

It can thus be seen that metal parts or foils that could oxidize are avoided, and the relatively long—at least 35 mm—members 3, 3*a*, 3*b* partly constitute means to reduce the high temperature that prevails at the electrodes 4 to a substantially lower value by the time it reaches the outermost part, 3*b*, which constitutes the terminal of the discharge tube.

The collars 2, if provided, are sealed to the envelope 1 by means of fused-glass or preferably ceramic seals 5 that ensure vacuum-tight connections. Similar layers 6 establish vacuum-tight seals between the collars 2 and the members 3, 3*a*, while further such layers 9 establish seals between the adapter tubes 8 that surround the parts 3*b* as well as the member 3 and parts 3*a*, which constitute the electrical elements on account of the metal(lization) 7 thereon.

It is important that the inlets, the lead-ins and the outer terminals on parts 3, 3*a* and 3*b* of the elongated member are vacuum-tightly sealed from the outside air within the respective adapter tubes 8, and that each member 3 is shaped as a respective single, monolithic, substantially cylindrical ceramic body, as shown, having the metal layer or metallized surface 7 thereon for electrical conduction, as was mentioned before.

The high-pressure electric discharge tube according to the present invention, which can be operated in the open air without any protective envelope, is made by first sealing or fusing one collar 2 onto an end of the envelope 1 of the illuminator. Then, while the collar 2 is held in a vertical position, one member 3, already provided with an electrode 4, and one adapter tube 8 are placed onto the collar 2, and the sealing layer 5 applied to the surfaces to be sealed and soldered, and subsequently melted in an inert-gas atmosphere having a pressure of 20 to 30 Hg mm.

It will be understood that if no collars 2 are being used there will be a direct fusing or sealed connection between the envelope 1 and each of the adapter tubes 8.

Once this is accomplished, the other end of the adapter tube 8 is sealed with the part 3*b* of the member 3, that has the layer 9 thereon, after the tube 8 has been rarified to a vacuum of approx. $10^{-2}$ Hg mm.

If inert gas is to be used inside the adapter tubes 8, as a filling gas, then the sealing or soldering of the inlet or terminal 3*b* of the member 3 of that tube 8 should be performed simultaneously with the described soldering of the first collar 2 (if provided).

Hereafter we take the envelope 1, semi-finished and closed at one end, and we apply the second collar 2 to its other end, with the sealing layer 5 thereon, bringing the envelope 1 into a vertical position, with the open end pointing upwards, and then we proceed with the closing of the open end and the formation of the second vacuum-tight seal in the before described manner.

During the operation of the discharge tube the collars 2, although constituting the coldest parts of the discharging space (at the respective ends of the envelope 1), are still heated to approx. 800° C. In order to prevent this space from dropping below the so-called "cold-spot temperature" that is necessary for attaining the required gas pressure, the inner surfaces of the collars 2, which touch the illuminator envelope 1, are heat insulated, preferably with a layer of ceramic kaolin or China-clay wool (not shown). This temperature is reduced, by way of the adapter tubes 8, to an extent that at the terminal parts 3*b* a value is attained at which the metal layer 7, which was said to be preferably tungsten or molybdenum, does not oxidize, not even in the open air. This reduction in temperature can be ensured however only by choosing the length of the adapter tubes 8 with at least 35 mm.

In another exemplary embodiment of the invention the ends of the illuminator and the adapter tubes 8 are closed in a conventional manner by short metal caps (not shown) which are electrically connected by elastic metal conductors.

Measurements performed on the discharge tubes according to this invention have shown that the tubes fully comply with the optical requirements and that permanent protection from oxidation has been accomplished at the terminals, lead-ins and conductors.

The novel discharge tubes were exhibited in Germany, and the periodical Lichttechnik published a review on pp. 289–291 of number 7, 1977 (year 29) under "Neuerungen bei Lichtquellen" (=innovations in light sources), by M. Guenther. Page 291 describes an envelope-less high-pressure sodium-gas discharge tube, according to this invention, and praises the same as "an interesting new development" of the assignee of this application. It is also stated that "the electrodes to the left and right of the discharge/burning/chamber are placed into a vacuum".

The exemplary illustration and description do not restrict the application of the device according to the invention, which applies to any discharge tube of the kind described that has the characeristics as enumerated.

What I claim is:

1. A high pressure air operable electric alkali vapor discharge tube comprising:

a light cylindrical ceramic or crystal envelope having therein an electrode at each end; a ceramic adapter tube at each end of said envelope, said adapter tube having a length of at least 35 mm. and being evacuated or filled with an inert gas; each of said adapter tubes being attached to a collar for heat insulation which is sealed between said envelope and said adapter; a common closure member at each end of said envelope, in vacuum tight contact with said collar and said adapter tube and in electrical contact with said electrode; the opposite ends of each closure member opposite and remote from said envelope being in electrical connection with an outside electrical source.

2. The tube of claim 1 wherein said vacuum tight contacts are fused vacuum tight seals.

3. The tube of claim 1 wherein said electrical connection is a metal film.

4. The tube of claims 1, 2, or 3 wherein said collar is ceramic or metal and said heat insulation which is a layer between adjoining portions of said envelope, said collars, and said inner ends of said adapter tubes, consists at least essentially of kaolin wool.

* * * * *